United States Patent [19]

Mitchell et al.

[11] 4,137,053

[45] Jan. 30, 1979

[54] GASIFICATION PROCESS

[75] Inventors: David S. Mitchell; David R. Sageman, both of San Rafael, Calif.

[73] Assignee: Chevron Research Company, San Francisco, Calif.

[21] Appl. No.: 887,700

[22] Filed: Mar. 17, 1978

Related U.S. Application Data

[60] Division of Ser. No. 811,496, Jun. 30, 1977, which is a continuation-in-part of Ser. No. 727,558, Sep. 28, 1976, abandoned.

[51] Int. Cl.[2] ..... C10J 3/46; C10J 3/54

[52] U.S. Cl. ..... 48/197 R; 48/202; 48/206

[58] Field of Search ..... 48/197 R, 202, 206, 48/210, DIG. 4; 432/197; 34/10, 57 A; 134/25 R; 208/8; 201/12, 16, 31; 423/659, DIG. 16, 659 F

[56] References Cited

U.S. PATENT DOCUMENTS

| | | | |
|---|---|---|---|
| 2,533,026 | 12/1950 | Matheson | 34/10 |
| 2,557,680 | 6/1951 | Odell | 201/12 |
| 2,701,758 | 2/1955 | Danulat et al. | 48/206 |
| 2,868,631 | 1/1959 | Woebcke | 48/206 |

*Primary Examiner*—S. Leon Bashore

*Assistant Examiner*—Peter F. Kratz

*Attorney, Agent, or Firm*—D. A. Newell; R. H. Davies; R. H. Evans

[57] ABSTRACT

A continuous process and apparatus are disclosed for the retorting or gasification of hydrocarbon-containing solids such as oil shale, coal, tar sands, etc., wherein the solids are retorted or gasified in a combined entrained and fluidized bed. A solid fluidized heat-transfer material flows downwardly through a conversion zone. Subdivided hydrocarbon-containing solids are introduced into a central portion of the conversion zone, with smaller particles of the solids being entrained and moving upwardly through the conversion zone countercurrent to the flow of the fluidized heat-transfer material, and larger particles of the solids being fluidized and moving downwardly through the conversion zone concurrent with the flow of the heat-transfer material. A fluidizing gas is injected into a lower portion of the conversion zone and a portion of the solids is combusted, providing the necessary heat for the conversion reactions. Substantially plug flow of the heat-transfer solid and the hydrocarbon-containing solids is maintained by including in the conversion zone means for impeding back mixing, such as a packing material filling the conversion zone.

11 Claims, 2 Drawing Figures

GASIFICATION PROCESS

This is a division of application Ser. No. 811,496, filed June 30, 1977, which is a continuation-in-part of Ser. No. 727,558, filed Sept. 28, 1976, abandoned.

BACKGROUND OF THE INVENTION

The present invention relates to the retorting and gasification of hydrocarbon-containing solids, particularly the retorting of oil shale.

In view of the recent rapid increases in the price of crude oil and natural gas, researchers have renewed their efforts to find alternate sources of energy and hydrocarbons. Much research has focused on recovering hydrocarbons from hydrocarbon-containing solids such as shale, tar sand or coal by pyrolysis and upon gasification of carbonaceous materials to convert solid carbonaceous material into more readily usable gaseous and liquid hydrocarbons. Other known processes involve combustion of solid carbonaceous materials with oxygen to generate energy. Pyrolysis, gasification and combustion processes typically employ a treatment zone, e.g., a reaction vessel, in which the solid is heated or reacted. The cost of these reaction zones and accompanying apparatus plays an important, often dominant part in determining the over-all economics of the process. Typically, reaction systems used can be characterized as either fluid bed, entrained bed or moving bed.

Typical of prior art schemes using a moving bed is the well-known Lurgi process. Crushed coal is fed into the top of a moving-bed gasification zone and upflowing steam endothermically reacts with the coal. Combustion of a portion of the char with oxygen below the gasification reaction zone supplies the required endothermic heat of reaction. The coal has a long residence time in the gasification reactor of about 1 hour.

A typical entrained-bed process is the well-known Koppers-Totzek process in which coal is dried, finely pulverized and injected into a treatment zone along with steam and oxygen. The coal is rapidly partially combusted, gasified and entrained by the hot gases. Residence time of the coal in the reaction zone is only a few seconds.

Typical of fluid-bed processes is the well-known Union Carbide/Battelle coal gasification process. Crushed and dried coal is injected near the bottom of a treatment zone containing a fluidized bed of coal. Heat for the reaction is provided by hot coal-ash agglomerates which drop through the fluidized bed of coal.

The above-noted processes have many disadvantages. For example, in moving-bed processes the solids residence time is long, necessitating either a very large contacting or reaction zone or a large number of reactors. In entrained-bed processes, the residence time of the solid is short, but very large quantities of hot gases must be utilized to heat the solids rapidly. In fluid-bed processes, the solids flow rate is low compared to entrained-bed processes, because gas rates must be kept low in order to maintain the solid in the fluidized state.

The use of fluidized-bed contacting zones has long been known in the art and has been widely used commercially in the fluid catalytic cracking of hydrocarbons. When a fluid is passed at a sufficient velocity upwardly through a contacting zone containing a bed of subdivided solids, the bed expands and the particles are buoyed and supported by the drag forces caused by the fluid passing through the interstices among the particles. The superficial vertical velocity of the fluid in the contacting zone at which the fluid begins to support the solids is known as the minimum fluidization velocity, and the velocity of the fluid at which the solid becomes entrained in the fluid is known as the terminal velocity. Between the minimum fluidization velocity and the terminal velocity, or entrainment velocity, the bed of solids is in a fluidized state and it exhibits the appearance and some of the characteristics of a boiling liquid.

Fluidized beds have been previously utilized in many conventional contacting processes. Fluidized beds are particularly advantageous where intimate contact between two or more fluidized solids or between solids and gases is desired. Because of the quasi-fluid or liquid-like state of the solids, there is typically a rapid over-all circulation of all the solids throughout the entire bed with substantially complete mixing, as in a stirred-tank reaction system. This rapid circulation is particularly advantageous in conventional processes in which a uniform temperature and reaction mixture is required throughout the contacting zone. On the other hand, a uniform bed temperature and provision of a uniformly mixed bed of solids is a disadvantage when it is desired to maintain a temperature gradient in the contact zone to separate or segregate various types of solids, or to carry out chemical reactions to high conversions.

Gas fluidized beds include a dense particulate phase and a bubble phase, with bubbles forming at or near the bottom of the bed. These bubbles generally grow by coalescence as they rise through the bed. Mixing and mass transfer are enhanced when the bubbles are small and evenly distributed throughout the bed. When too many bubbles coalesce so that large bubbles are formed, a surging or pounding action results, leading to less efficient heat and mass transfer.

The problem of surging or slugging in fluidized beds is not fully understood. An article by D. Geldart, *Powder Technology,* 7 (1973), 285–292, discusses various characteristics of fluidized beds and indicates that the phenomenon of slugging is influenced by the density of the fluidization gas, the density of the particles and the mean particle size.

Various solutions have been proposed for controlling slugging in fluidized beds. The use of baffles and other internal structural members or obstacles has been suggested, as for example in U.S. Pat. No. 2,533,026. Internal devices, however, impede over-all, substantially complete mixing of solids, which is desired in most conventional fluidized-bed processes.

U.S. Pat. No. 2,376,564 discloses a process in which a fluidized catalyst is used to catalytically crack an upflowing gaseous hydrocarbon. This patent furthermore discloses the use of a non-fluidized, heat-transfer material such as balls or pellets.

U.S. Pat. No. 3,927,996 discloses a process in which pulverized coal is carried through a portion of a bed of fluidized char. The fluidized char is introduced into a lower portion of the gasifier and reacts with steam to produce a synthesis gas.

U.S. Pat. No. 2,557,680 discloses a fluidized-bed carbonization process including a reaction zone and a regeneration zone. The reactor may contain packing material.

U.S. Pat. No. 2,700,592 discloses a fluidized-bed process for desulfurizing sulfide ores.

U.S. Pat. No. 2,868,631 discloses a fluidized bed process for gasifying coal which employs a reactor containing packing material.

U.S. Pat. No. 3,853,498 discloses a fluidized-bed process in which sand is employed for heating municipal waste.

Shale oil is not a naturally occuring product, but is formed by the pyrolysis or distillation of organic matter, commonly called kerogen, present in certain shale-like rock. The organic material has a limited solubility in ordinary solvents, making recovery by extraction uneconomical. Upon strong heating, the organic material decomposes into a gas and liquid. Residual carbonaceous material typically remains on the retorted shale.

Retorting of oil shale and other similar hydrocarbon-containing solids is basically a simple operation, which involves heating the solid material to the proper temperature and recovering the vapors evolved. However, to provide a commercially feasible process, it is necessary to consider and properly choose one of the many possible methods of physically moving the solids through a reaction, or conversion, zone in which the retorting is to be carried out as well as the many other interrelated operating parameters. The choice of a particular method of moving the solids through the reaction zone must include a consideration of the mechanical aspects as well as the chemistry in the processes involved. Further, it is necessary to consider the many possible sources of heat that may be used for the pyrolysis or destructive distillation.

In order to provide a retorting process which is economically attractive and produces the maximum amount of high-quality shale oil, the operating parameters must be carefully controlled so that the over-all process is continuous and highly reliable. Any equipment used in the process, e.g., the equipment used to provide the conversion zone, must permit a high throughput of materials, since enormous quantities of oil shale must be processed for a relatively small recovery of shale oil.

In an effort to provide an economically commercial process, many retorting processes have been proposed, offering somewhat different combinations of the many possible operating conditions and apparatus. The cost of reaction vessels and the accompanying apparatus or means for transferring reactants and heat into or from these vessels plays an important, and frequently dominant, part in determining the over-all economics of a given process. Typically the types of vessels or reactors utilized to provide the conversion zone can be characterized as being either fluid bed, entrained bed or moving bed.

Many of the disadvantages of prior art processes are avoided or overcome by the process of the present invention, which, in one aspect, involves the unique use of a combined fluidized and entrained bed process for the retorting of hydrocarbon-containing solids such as oil shale. The process of the present invention is unique in many aspects, but particularly with regard to the high throughput of the solids per unit volume of reactor coupled with the ability to retort a wide size range of solids.

SUMMARY OF THE INVENTION

In one embodiment, the present invention relates to a continuous process for retorting hydrocarbon-containing solids in a vertically elongated retorting zone, the retorting zone including means for substantially impeding vertical back mixing of vertically moving solids substantially throughout the retorting zone;

(a) introducing particulate solid heat-transfer material at an elevated temperature into an upper portion of the retorting zone;

(b) maintaining an upward flow of a fluidization gas through the retorting zone at a rate sufficient to maintain the heat-transfer material in a fluidized state;

(c) introducing into an intermediate level of the retorting zone a first portion of hydrocarbon-containing solids which is entrained by the fluidization gas and flows upwardly through the retorting zone whereby the first portion of the solids is heated to an elevated retorting temperature by contact with the heat-transfer material and the fluidization gas thereby forming a first portion of retorted solids and a first portion of vaporized hydrocarbons;

(d) introducing into an intermediate level of the retorting zone a second portion of hydrocarbon-containing solids which is fluidized by the fluidization gas and which flows downwardly through the retorting zone whereby the second portion of the solids is heated to an elevated retorting temperature by contact with the heat-transfer material and the fluidization gas thereby forming a second portion of retorted solids and a second portion of vaporized hydrocarbons;

(e) reacting the second portion of the retorted solids in a lower level of the retorting zone with an oxygen-containing gas thereby forming combusted solids and a noncombustion-supporting fluidization gas, whereby the down-flowing heat-transfer material is heated to an elevated temperature;

(f) maintaining a substantially net downward flow of the heat-transfer material and the second portion of the hydrocarbon-containing solids through the retorting zone by withdrawing from a bottom portion of the retorting zone a first effluent stream comprising the heat-transfer material and the combusted solids, the effluent stream being withdrawn at an elevated temperature;

(g) withdrawing from an upper portion of the retorting zone a second effluent stream comprising the fluidization gas containing the first and second portions of the vaporized hydrocarbons and the first portion of the retorted solids.

In another embodiment, the present invention relates to a continuous process for gasifying hydrocarbon-containing solids in a vertically elongated gasification zone, the gasification zone including means for substantially impeding vertical back mixing of vertically moving solids substantially throughout the gasification zone, which comprises:

(a) introducing particulate solid heat-transfer material at an elevated temperature into an upper portion of the gasification zone;

(b) maintaining an upward flow of a steam-containing fluidization gas through the gasification zone at a rate sufficient to maintain the heat-transfer material in a fluidized state;

(c) introducing into an intermediate level of the gasification zone a first portion of hydrocarbon-containing solids which is entrained by the fluidization gas and flows upwardly through the gasification zone and reacts with the fluidization gas forming a first portion of partially gasified solids and a first portion of combustible gas;

(d) introducing into an intermediate level of the gasification zone a second portion of hydrocarbon-containing solids which is fluidized by the fluidization gas and which reacts with the fluidization gas forming a second portion of partially gasified solids and a second portion of combustible gas;

(e) reacting the second portion of the partially gasified solids in a lower level of the gasification zone with an oxygen-containing gas thereby forming combusted solids and a noncombustion-supporting fluidization gas, whereby the heat-transfer material is heated to an elevated temperature;

(f) maintaining a substantially net downward flow of the heat-transfer material and the second portion of the hydrocarbon-containing solids through the gasification zone by withdrawing from a bottom portion of the gasification zone a first effluent stream comprising the heat-transfer material, the effluent stream being withdrawn at an elevated temperature;

(g) withdrawing from an upper portion of the gasification zone a second effluent stream comprising a product combustible gas and the first portion of the partially gasified solids.

In a further embodiment, the present invention relates to a continuous process for retorting hydrocarbon-containing solids in a vertically elongated vessel substantially filled with a packing material, which comprises:

(a) introducing particulate solid heat-transfer material at an elevated temperature into an upper portion of the vessel;

(b) maintaining an upward flow of a fluidization gas through the vessel at a rate sufficient to maintain the heat-transfer material in a fluidized state;

(c) introducing into an intermediate level of the vessel a first portion of hydrocarbon-containing solids which is entrained by the fluidization gas and flows upwardly through the vessel whereby the first portion of the solids is heated to an elevated retorting temperature by contact with the heat-transfer material and the fluidization gas thereby forming a first portion of retorted solids and a first portion of vaporized hydrocarbons;

(d) introducing into an intermediate level of the vessel a second portion of hydrocarbon-containing solids which is fluidized by the fluidization gas and which flows downwardly through the vessel whereby the second portion of the solids is heated to an elevated retorting temperature by contact with the heat-transfer material and the fluidization gas thereby forming a second portion of retorted solids and a second portion of vaporized hydrocarbons;

(e) reacting the second portion of the retorted solids in a lower level of the vessel with an oxygen-containing gas thereby forming combusted solids, a noncombustion-supporting fluidization gas, and whereby the down-flowing heat-transfer material is heated to an elevated temperature;

(f) maintaining a substantially net downward flow of the heat-transfer material and the second portion of the hydrocarbon-containing solids through the vessel by withdrawing from a bottom portion of the vessel a first effluent stream comprising the heat-transfer material and the combusted solids, the effluent stream being withdrawn at an elevated temperature;

(g) withdrawing from an upper portion of the vessel a second effluent stream comprising the fluidization gas containing the first and second portions of the vaporized hydrocarbons and the first portion of the retorted solids.

In another embodiment, the present invention relates to a continuous process for gasifying hydrocarbon-containing solids in a vertically elongated vessel substantially filled with a packing material, which comprises:

(a) introducing particulate solid heat-transfer material at an elevated temperature into an upper portion of the vessel;

(b) maintaining an upward flow of a steam-containing fluidization gas through the vessel at a rate sufficient to maintain the heat-transfer material in a fluidized state;

(c) introducing into an intermediate level of the vessel a first portion of hydrocarbon-containing solids which is entrained by the fluidization gas and flows upwardly through the vessel and reacts with the fluidization gas forming a first portion of partially gasified solids and a first portion of combustible gas;

(d) introducing into an intermediate level of the vessel a second portion of hydrocarbon-containing solids which is fluidized by the fluidization gas and which reacts with the fluidization gas forming a second portion of partially gasified solids and a second portion of combustible gas;

(e) reacting the second portion of the partially gasified solids in a lower level of the vessel with an oxygen-containing gas thereby forming combusted solids, a noncombustion-supporting fluidization gas, and whereby the heat-transfer material is heated to an elevated temperature;

(f) maintaining a substantially net downward flow of the heat-transfer material and the second portion of the hydrocarbon-containing solids through the vessel by withdrawing from a bottom portion of the vessel a first effluent stream comprising the heat-transfer material, the effluent stream being withdrawn at an elevated temperature;

(g) withdrawing from an upper portion of the vessel a second effluent stream comprising a product combustible gas and the first portion of the partially gasified solids.

In a further embodiment, the present invention relates to a process for retorting hydrocarbon-containing solids in a vertically elongated retorting zone, the retorting zone containing means for impeding vertical back mixing of vertically moving solids substantially throughout the retorting zone, which comprises the steps of:

(a) introducing particulate solid heat-transfer material into an upper end of the retorting zone at an elevated temperature and withdrawing heat-transfer material from a lower end of the retorting zone;

(b) passing a fluidization gas stream upwardly through the retorting zone at a rate sufficient to substantially fluidize the heat-transfer material, whereby the heat-transfer material substantially flows downwardly through the retorting zone in plug flow;

(c) introducing the hydrocarbon-containing solids into an intermediate vertical level of the retorting zone, the fluidization gas stream having a superficial velocity such that a first portion of the hydrocarbon-containing solids is entrained in the fluidization gas stream and flows upwardly through the retorting zone and a second portion of the hydrocarbon-containing solids is fluidized by the fluidization gas stream and flows downwardly through the retorting zone with the heat-transfer material;

(d) heating the hydrocarbon-containing solids and forming vaporized hydrocarbons and retorted solids by contacting the hydrocarbon-containing solids with the heat-transfer material and the fluidization gas stream;

(e) heating the heat-transfer material and the fluidization gas stream by combusting downwardly flowing retorted solids formed from the second portion of the hydrocarbon-containing solids; and (f) removing the vaporized hydrocarbons from the upper end of the retorting zone in the fluidization gas stream.

In another embodiment, the present invention relates to a process for gasifying hydrocarbon-containing solids in a vertically elongated gasification zone, the gasification zone containing means for impeding vertical back mixing of vertically moving solids substantially throughout the gasification zone, which comprises the steps of:

(a) introducing particulate solid heat-transfer material into an upper end of the gasification zone at an elevated temperature and withdrawing heat-transfer material from a lower end of the gasification zone;

(b) passing a fluidization gas stream upwardly through the gasification zone at a rate sufficient to substantially fluidize the heat-transfer material, whereby the heat-transfer material substantially flows downwardly through the gasification zone in plug flow;

(c) introducing the hydrocarbon-containing solids into an intermediate vertical level of the gasification zone, the fluidization gas stream having a superficial velocity such that a first portion of the hydrocarbon-containing solids is entrained in the fluidization gas stream and flows upwardly through the gasification zone and a second portion of the hydrocarbon-containing solids is fluidized by the fluidization gas stream and flows downwardly through the gasification zone with the heat-transfer material;

(d) heating the hydrocarbon-containing solids and forming a product gas and partially gasified solids by contacting the hydrocarbon-containing solids with steam in the fluidization gas stream and with the heat-transfer material;

(e) heating the heat transfer material and the fluidization gas stream by combusting downwardly flowing partially gasified solids formed from the second portion of the hydrocarbon-containing solids; and (f) removing the product gas from the upper end of the gasification zone in the fluidization gas stream.

DETAILED DESCRIPTION OF THE INVENTION AND PREFERRED EMBODIMENTS

While the process of the present invention is described hereinafter with particular reference to the processing of shale, it will be apparent that the process can also be used to retort other hydrocarbon-containing solids as defined herein. Similarly, the process of the present invention can be used to gasify hydrocarbon-containing solids as defined herein.

The term "hydrocarbon-containing solids" as used herein includes, for example, oil shale, cil sand, coal, tar sands, gilsonite, peat, mixtures of two or more of these materials or any other hydrocarbon-containing solids with inert materials, etc.

As used herein the term "oil shale" means inorganic material which is predominantly clay, carbonates and silicates in conjunction with organic compounds composed of carbon, hydrogen, sulfur, and nitrogen, called "kerogen".

The term "retorted solid" is used herein to mean hydrocarbon-containing solids from which a substantial portion, and preferably essentially all, of the volatilizable hydrocarbons have been removed, but which may still contain residual carbon.

The term "spent solids" or "combusted solids" is used herein to mean retorted or gasified solids from which essentially all of the combustible residual carbon has been removed.

The terms "condensable", "normally gaseous" and "normally liquid" is relative to the condition of the material at 77° F. (25° C.) at one atmosphere.

The term "gasification" is used herein to describe processes in which a carbonaceous or hydrocarbon-containing solid reacts with a gas, such as the endothermic reaction of coal with steam.

The reaction zone, e.g., a retorting zone or gasification zone, used in the present process may be defined by any conventionally constructed vessel, shell, reactor, etc., which is capable of containing the solids, liquids and gases employed and generated in the process at the pressures and temperatures used. Often, a retorting or gasification vessel includes conventional disengaging zones at the top end, bottom end (or both) of the reaction zone to permit a desired disengagement of solids from fluids. The use of various vessels, reactors, shells, etc., with or without a disengaging zone at either the top or bottom end thereof to provide a reaction zone for use according to the present invention is within the ability of those skilled in the art from the description provided herein.

The process of the present invention is best understood by reference to the accompanying figures.

Figure 1:
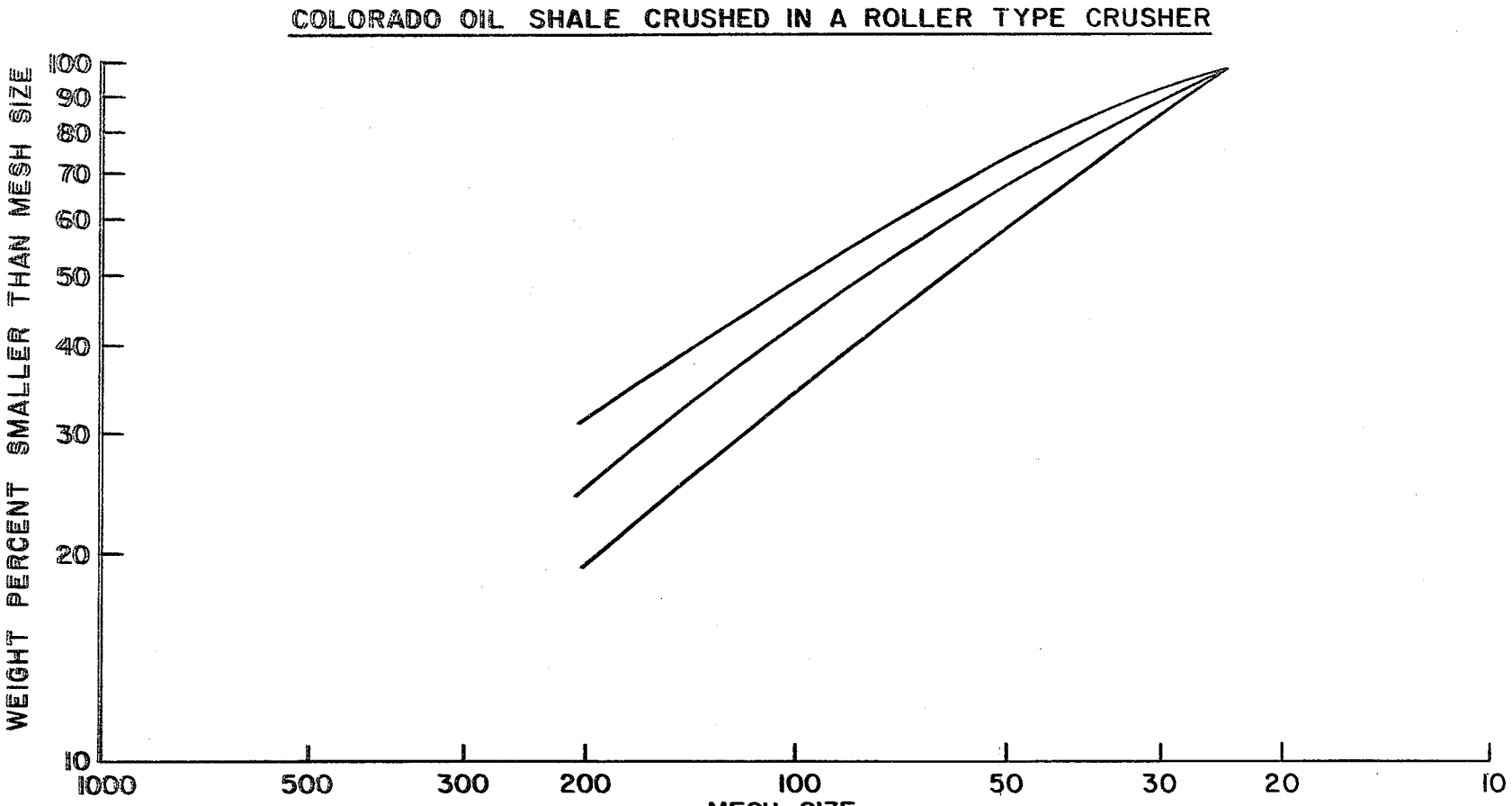
FIG. 1 illustrates typical size distributions for various grades of crushed oil shales.

Conventionally, oil shale must be precrushed prior to being fed into a retort in order to reduce the retorting time. In many conventional processes, it is desirable to have a relatively uniformly sized crushed shale feed. However, a typical crushing operation produces a wide size range of solids. For example, FIG. 1 illustrates a typical size distribution for various grades of Colorado oil shale crushed in a roller crusher such that 100% of the oil shale passes through a 25-mesh screen. As shown in FIG. 1, the crushed oil shale has a wide size distribution, with about 30 weight percent of the solids being smaller than 200 mesh and about 50 weight percent being smaller than 100 mesh. All mesh sizes in the present specification are relative to the Tyler Standard Sieve Series.

Figure 2:
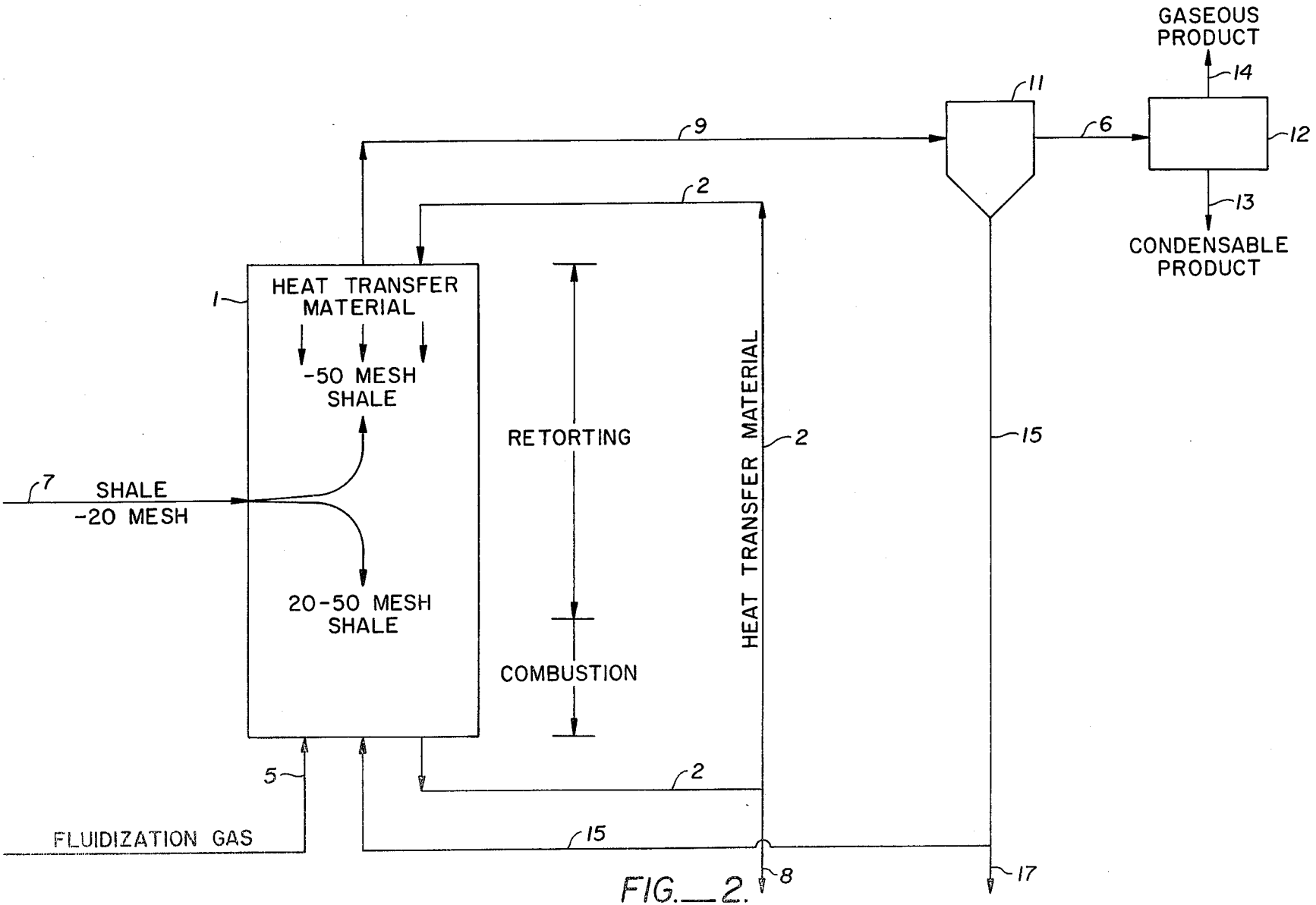
FIG. 2 is a schematic flow diagram illustrating the flow of gases and solids through a retorting vessel along with some auxiliary processing equipment.

Referring now to FIG. 2, a particulate solid heat-transfer material is continuously introduced by conventional means at an elevated temperature, for example in the range 825° to 1400° F., into an upper portion of a vertically elongated retorting zone defined by a retorting vessel 1 via conduit 2. The particulate solid heat-transfer material is preferably inert and may be in the form of granules, balls or pellets. When processing oil shales, preferably the heat-transfer material comprises spent shale at a temperature in the range 825° to 1400° F., preferably 950° to 1050° F.

An essential feature of the present invention is that the reaction zone, e.g., the interior of a vessel, include means for substantially impeding back mixing of both upflowing solids and downflowing solids. The means for impeding back mixing must substantially impede back mixing throughout substantially the whole reaction zone. A primary object of including means for impeding back mixing in the reaction zone is to maintain essentially plug flow of both upwardly moving solids and downwardly moving solids. Suitable means for impeding back mixing, i.e., means for providing essentially plug flow of solids, include packing materials, i.e., fixed beds of subdivided materials not attached to the wall of a vessel, reactor or shell defining the reaction zone. Suitable means for impeding back mixing to provide essentially plug flow of solids also include internal apparatus fixed to the wall of a vessel, reactor or shell defining the reaction zone.

Maintaining continuous plug flow substantially throughout the reaction zone has many advantages. Plug flow, wherein there is little or no gross back mixing of solids in the treatment zone, provides much higher conversion levels of carbonaceous material in a smaller reaction zone volume than can be obtained, for example, in fluidized-bed reactors with gross top-to-bottom mixing, even when the fluidized-bed reactors are divided into 2 to 5 distinct fluid bed zones. In conventional unpacked fluidized beds or in stirred-tank-type reactors, the product stream removed from the conventional reaction zone approximates the average conditions in the conventional reaction zone. Thus, in such processes, unreacted or partially reacted material is necessarily removed with the product stream, leading to costly separation and recycle of unreacted materials. Maintaining plug flow and preventing top-to-bottom back mixing of solids, on the other hand, allows one to operate the process of the present invention on a continuous basis with the residence time being precisely controllable.

The use of means for preventing back mixing of solids, such as packing material also permits a substantial reduction in the size of the reaction zone required, since the need for a large disengaging zone (as is normally required in unpacked fluidized beds) is eliminated. In many systems with fluid beds in which back mixing is not prevented, a large portion of the volume of the vessel, frequently from 50% to 80%, is conventionally used as a disengaging zone. Bubbles formed in the fluid bed burst at the top of the bed, spouting upwardly a large amount of material. A large disengaging zone is necessary in such conventional systems to allow this material to drop back into the fluid portion of the bed and avoid carry-over of the solids out of the vessel along with the fluidizing gas. Since coalescence of large bubbles is prevented in the present invention, this bursting is essentially eliminated, allowing the size of the disengaging zone to be substantially reduced.

Plug flow of the solids in the reaction zone is obtained by providing the reaction zone with means for impeding back mixing, such as packing material. By "substantially plug flow" it is meant that there is no top-to-bottom back mixing and only localized back mixing of the solids as they flow through the reaction zone. As the degree of top-to-bottom back mixing increases in the reaction zone, the efficiency of the present process decreases. Therefore, gross back mixing (top-to-bottom back mixing in the reaction zone) must be avoided in the present process throughout the reaction zone.

While gross back mixing must be avoided, highly localized mixing is desirable in that it increases the degree of contacting between the solids and gases. The degree of back mixing is, of course, dependent on many factors, particularly the bed depth and the means employed for impeding back mixing. In order to impede back mixing throughout substantially the whole reaction zone when using packing material, the preferred means for impeding back mixing, the packing material is used in an amount sufficient to fill or substantially fill the reaction zone, except for any disengaging space at the top or bottom of a vessel defining the reaction zone.

Packing materials are the preferred means for impeding back mixing in carrying out the process of the invention. Numerous packing materials known to those skilled in the art include spheres, cylinders and other specially shaped items, etc. Any of these numerous packing materials may produce the desired effect in causing the gross vertical flow of solids to be substantially plug-like in nature while causing highly localized mixing. A particularly preferred packing material which is well known to those skilled in the art is pall rings. Pall rings are, in general, cylindrical in shape with a portion of the wall of the cylinder being projected inwardly, which promotes localized circulation of the solids and gases and which prevents the problem of some solid-wall-type packings in permitting channeling to occur or gravitation of solids or gases toward the reactor wall. Pall rings are commercially available in many sizes, including sizes from less than 1 inch in diameter to more than 3 inches in diameter. The choice of size will, of course, depend upon many other factors, such as the bed depth and vessel diameter. These design features and others are, of course, readily determined by any person skilled in the art.

The means employed for impeding back mixing may also be "fixed"-type internals. Examples of suitable internals which are typically fixed to the wall of a vessel, shell, reactor, or the like, wholly or partly defining the reaction zone are horizontal tubes and/or rods, vertical tubes and/or rods, combinations of horizontal tubes and/or rods and vertical tubes and/or rods, slats, screens and grids with and without downcomers, perforated plates with and without downcomers, bubble caps with and without downcomers, Turbogrid trays, Kittle plates, corrugated baffles, combinations of horizontal grids and wire spacers, combinations of two or more of the above-listed apparatus, and like internals used by those skilled in the art, conventionally fixed to the wall of vessels for impeding flow therein. Thus, although packing materials such as pall rings are particularly preferred means for impeding back mixing in the reaction zone, the above-described internals typically fixed to the wall of a vessel can also be used, either as a substitute for the packing or in combination with the packing material. In order to impede back mixing substantially throughout the reaction zone, internals fixed to the wall of a vessel defining the reaction zone must be positioned substantially throughout the reaction zone. That is, the internals are used to provide the same effect as would be obtained by substantially filling the reaction zone with a packing material, such as pall rings. The primary object of using either packing material or other internals fixed to a reactor or vessel wall is, of course, to provide plug-type flow of the upflowing solids and the downflowing solids throughout substantially the whole reaction zone.

For many conventional uses, means for preventing back mixing are often fabricated from metals such as steel. In carrying out the process of this invention it is preferred that a ceramic material (or other material similarly resistant to heat, attrition and corrosion) is used for fabricating the means, such as packing material, chosen for use in preventing back mixing. For example, conventional pall rings are usually formed from stainless steel, whereas pall rings fabricated from a heat-, attrition-, and corrosion-resistant ceramic material are preferred when pall rings are used as a means for preventing back mixing according to the present invention.

A further advantage of employing means in the reaction zone for impeding back mixing and a critical aspect of the invention with some types of fluidized material is the prevention of slugging in the fluidized bed. In many fluidized beds, the bubbles of fluidized solids tend to coalesce much as they do in a boiling liquid. When too many bubbles coalesce, surging or pounding in the bed results, leading to a loss of efficiency in contacting. Extensive slugging occurs when enough bubbles coalesce to form a single bubble which occupies the entire cross section of the vessel. This bubble then proceeds up the vessel as a slug. The rate and nature of the coalescence of these bubbles is not fully understood by those skilled in the art but apparently depends on many factors, particularly the height and diameter of the bed and the particles density and the size. One study by Geldart, *Powder Technology,* 7 (1973) 285–292, the entire disclosure of which is incorporated herein by reference, characterizes various types of particles and their tendency for slugging. Geldart characterizes particles as being either type A, B or C.

Type B particles are characterized in that naturally occurring bubbles start to form at only slightly above the minimum fluidization velocity. Type B particles are also characterized in that there is no evidence of a maximum bubble size and coalescence is the predominant problem. Sand is a type B solid.

Thus, in the present invention, when sand (the preferred fluidized solid heat-transfer material for use in gasification according to the invention) is used for heat transfer, it is critical to maintaining plug-type flow that bubble coalescence be minimized by the inclusion of means for impeding top-to-bottom solids mixing in the reaction zone, e.g., packing material. Pall rings is the preferred type of packing material when a type B solid is being fluidized, and particularly when sand is fluidized.

Still another important advantage of the use of means for preventing top-to-bottom mixing, e.g., packing material, in combination with the downflowing heat-transfer solid is that the volume of the reaction zone can be substantially reduced in size relative to prior art entrained-bed processes, because the combination of the packing material, or other means for impeding top-to-bottom mixing, and the downflowing heat-transfer solid substantially increases the hold-up time of upwardly flowing entrained solids. In prior art processes involving entrained-bed flow, the residence time of the solid per linear foot of reactor is generally very low. This necessitates either: (1) grinding the reactant solid to a very small size so that it reacts relatively rapidly; (2) building relatively tall, expensive reactors to increase the total residence time of the solid; or (3) operating the reactor at a very high temperature in order to obtain a very fast reaction.

In the process of the present invention, upward flow of entrained solid material is substantially impeded by the means employed for impeding top-to-bottom mixing, e.g., packing material. In most cases, depending upon the choice of particular means for impeding gross mixing throughout the reaction zone and other factors, the solids hold-up time of entrained solids is at least several times and often orders of magnitude greater than with prior art processes, such as the Koppers-Totzek process. This aspect of the present process is particularly important, because in many gasification and retorting processes the gasification and retorting vessels frequently represent 10% to 50% of the capital cost of the process. By doubling the entrained solids hold-up time, capital costs can be substantially reduced.

Referring to FIG. 2, a stream of fluidization gas is introduced by conventional means into a bottom portion of the vessel 1 via conduit 5 and flows upwardly through the vessel at a rate sufficient to maintain the heat-transfer material in a fluidized state in the vessel. If necessary, additional gas may be introduced or withdrawn from the vessel at various points along, or vertical levels of, the vessel in order to maintain solids in a fluidized state. The linear velocity of the fluidization gas stream in the retorting zone can vary greatly, depending on many variables, but particularly on the fluidization characteristics of the solid heat-transfer material. Typically the linear velocity of the fluidization gas will be in the range of 1 to 20 ft/sec, and preferably 3 to 7 ft/sec. For retorting, the fluidization gas preferably initially contains molecular free oxygen, but may also contain other gases, for example steam or recycled product gases.

Other suitable fluidizing gases, in addition to steam and oxygen, include air, CO, $CO_2$, $H_2$, methane, ethane and other light hydrocarbons, recycled product gas and mixtures of the above. The type of fluidizing gas chosen for a particular application of the present process will, of course, depend primarily on the reactions to be promoted, and the choice of a suitable fluidizing gas composition will be within the ability of those skilled in the art. Whether the gas or gases chosen are reactive or inert will, of course, depend partly upon the type of solid carbonaceous material and will particularly depend on the other reaction conditions maintained in the vessel including temperature, pressure and residence time. It is apparent that the composition of the fluidizing gas stream will change as the gas stream flows upwardly through the contacting zone, and when withdrawn will include product gas and/or a vaporized portion of the solid feed material.

For retorting, the fluidization gas introduced preferably contains only enough oxygen so that combustion reactions are limited to a lower portion of the retorting zone. As the fluidization gas travels up through the retorting zone, its composition changes, and when removed from the vessel it includes the vaporized hydrocarbon-product and reaction-product gases.

An essential feature of the present invention involves maintaining a substantially net downflow of fluidized solids through the vessel. This net downward flow is maintained by withdrawing by conventional means the fluidized solids from a bottom portion of the vessel via conduit 2. The heat-transfer material may be withdrawn from the vessel at an elevated temperature in the range 825° to 1400° F. and reintroduced by conventional means, while hot, into an upper portion of the vessel via conduit 2. The net downflow of fluidized solids can vary from about 0.1 to 15 ft/min., but more typically it will be in the range 0.2 to 5.0 ft/min.

A stream of precrushed oil shale, having a size distribution as shown in FIG. 1, is introduced by conventional means, for example, by a screw-type feeder, into an intermediate vertical level of the vessel 1 via conduit 7. This shale may be preheated prior to introduction into the vessel, but preferably it is introduced at ambient temperature. It will now be assumed for the purpose of illustrating the invention that the precrushed shale comprises a stream of 20-minus-mesh shale, as shown in FIG. 1. As is readily apparent to any person skilled in the art, the process variables can be optimized for processing precrushed oil shale of other size distributions in accordance with the teaching of the present invention.

A portion of the oil shale, for example that portion comprising the 20- to 50-mesh material, is fluidized by the upflowing fluidization gas. However, because of the presence in the vessel of means for impeding back mixing of solids, coupled with the net downward flow of the heat-transfer material through the vessel, the 20- to 50-mesh portion of the shale does not undergo top-to-bottom mixing in the vessel, but rather moves downwardly through the vessel in substantially plug-type flow. As the 20- to 50-mesh stream moves downwardly through the retort, it is rapidly heated to an elevated retorting temperature in the range 800° to 1400° F. by contact with the downflowing heat-transfer material and the upflowing stream of fluidization gas. As the 20- to 50-mesh stream moves downwardly, it is retorted and the vaporized hydrocarbons are immediately entrained in the fluidization gas and are carried out of the vessel. The downwardly moving retorted solids still contain residual carbon. These fluidized, retorted solids eventually contact an oxygen-containing portion of the fluidization gas in a lower level of the vessel whereby the residual carbon is combusted, forming combusted solids, i.e., spent shale and a noncombustion supporting fluidization gas. Burning the residual carbon on the retorted shale also serves the important purpose of heating the upflowing fluidization gas to an elevated retorting temperature. Fluidized spent shale and the heat-transfer material are removed at an elevated temperature in the range 825° to 1400° F. from the bottom end of the retorting zone at a lower portion of the vessel via conduit 2 and the heat-transfer material is recycled by conventional means, such as by the use of a lift gas, to the top of the vessel via conduit 2 and reintroduced into the vessel. If the heat-transfer material has a different composition from fluidized spent solids, then the heat-transfer material is separated from spent solids by conventional means not shown. However, when processing shale, it is preferred to use spent shale as the heat-transfer material, and therefore a portion of the spent shale must be removed from the system via conduit 8 in order to prevent a buildup of solids.

Another portion of the feed shale, that is, the portion comprising the 50-minus-mesh material, is too small to be fluidized by the upflowing fluidization gas and instead is entrained by the upflowing gas. However, instead of being immediately swept out of the vessel by the upflowing gas, the upward movement of entrained shale is slowed by two means. First, it is slowed by contact with the downward-moving solid heat-transfer material, and second, it is slowed by the contact with the means for impeding back mixing provided in the vessel, e.g., packing material. The back-mixing impeding means prevents gross top-to-bottom mixing of the heat-transfer material and the entrained, 50-minus-mesh shale, so that flow of the entrained solids upwardly through the vessel is plug-like in nature. The two portions of hydrocarbon-containing solids, that is the 20- to 50-mesh (fluidized) portion and the 50-minus-mesh (entrained) portion can, of course, be introduced into the vessel separately. Preferably, of course, the fluidized portion and entrained portion are introduced together, thus avoiding separation costs.

As the entrained 50-minus-mesh shale flows upwardly with the upwardly moving gases, it is heated to an elevated retorting temperature, for example, in the range 825° to 1400° F. by contact with the hot downwardly moving heat-transfer material and the hot upflowing fluidization gases. The fluidization gas stream contains vaporized hydrocarbons and entrained, retorted 50-minus-mesh shale at the top end of the retorting zone. It is withdrawn by conventional means from the top end of the retorting zone at an upper portion of the vessel via conduit 9 and passed to separation zone 11, where the entrained, retorted solids are separated from the gases by conventional means such as a hot cyclone separator.

A condensable product stream 13 and a gaseous product stream 14 are separated in condensation zone 12. The condensable product stream includes $C_5$ and higher-boiling hydrocarbons while the gaseous stream includes methane, ethane, propane, butane, CO, $CO_2$ and $H_2$. The $C_3$ and $C_4$ portions of the gaseous product may be recovered by a low-temperature condensation step if desired. Portions of the gaseous product may also be used as part of the fluidization gas.

The hot retorted solids withdrawn from the upper portion of the vessel entrained in the fluidizing gas often still contain residual carbon. The energy value of this residual carbon can be recovered either by burning the carbon in a secondary vessel (not shown) or by injecting the 50-minus-mesh material via conduit 15 into a lower portion of vessel 1, whereby it is combusted and entrained upwardly through the vessel, providing additional heat for retorting. If 50-minus-mesh retorted material is reinjected into the vessel, then a portion of the solids entrained through the vessel must be bled off via conduit 17 in order to prevent a buildup of fines in the system.

Sufficient molecular oxygen must be introduced into the fluidization gas stream to at least combust the carbon on the downward-moving retorted oil shale. Preferably the oxygen content of the fluidization gas is limited so that only the residual carbon on the retorted shale is combusted, and essentially no combustion of the vaporized hydrocarbons occurs. Combustion of the retorted shale in the process of the present invention is only possible due to the presence in the retorting zone of means, such as packing material, for impeding back mixing of the vertically flowing solids. This creates a pseudo, plug-like flow of solids and gases through the vessel in contrast to most prior art fluidized bed processes wherein gross top-to-bottom mixing occurs. As the fluidization gas stream passes upwardly through the vessel it changes composition, and it preferably contains essentially no molecular oxygen by the time it reaches a vertical level at which is found oil shale which still contains unretorted volatizable hydrocarbons. Thus, combustion is preferably limited to a lower level (combustion portion) of the vessel, as indicated in FIG. 2.

The height of the vessel employed, and of the reaction zone above and below the hydrocarbon-containing solids introduction point is selected such that any of the solids which are immediately entrained and flow upwardly through the vessel are completely retorted before removal, and carbon in those solids which are fluidized and flow downwardly is completely combusted before removal of the solids from the vessel.

That portion of the shale which is entrained upwardly through the vessel as compared to that portion which is fluidized and flows downwardly can vary greatly, depending on many factors, but primarily on the flow rate of the fluidization gases. For processing shale, preferably 5 to 60 weight percent and more preferably 20 to 50 weight percent of the shale is entrained upwardly through the vessel, with the remaining shale being fluidized and flowing downwardly.

The present invention as applied to the retorting of hydrocarbon-containing solids, particularly shale, offers many advantages, including:

1. A continuous process for retorting solids which requires only one main reaction vessel and little auxiliary equipment;

2. The means, such as packing material, provided in the reactor for impeding solids back mixing ensures intimate solid-gas and solid-solid contacting and control of slugging, and promotes the vertical plug flow of solids.

3. The use of a combination of an entrained bed and a fluidized bed allows a wide size range of solids to be retorted;

4. Solids separation is simplified, since the process only requires separation of solids from products at one point;

5. Hydrocarbon products are rapidly transported out of the vessel;

6. A high retort throughput is provided;

7. A high thermal efficiency is achieved because the process can handle a wide size range of solids, reducing the energy costs associated with crushing shale to a uniform size;

8. A high yield of shale oil is obtained, since a wide size range of solids can be processed, in contrast to many prior art processes in which significant portions of the crushed shale must be discarded as being too small.

The present invention has been described above primarily in a specific embodiment for retorting of shale, but the invention is also applicable to the processing of other hydrocarbon-containing solids as defined herein and can easily be adapted for processing these other solids by one skilled in the art from the foregoing description. For example, in the retorting of coal it is preferred to use sand as the heat-transfer material, since the coal ash, being relatively fine, would substantially all be entrained, exiting the vesel with the fluidization gas stream. With tar sand, on the other hand, it is preferred to use appropriately sized spent sand as the heat-transfer material.

The process of the present invention can also be used for the gasification of carbonaceous and hydrocarbon-containing solids, particularly coal or coke, to produce a product combustible gas. Only obvious minor changes are required for a gasification process from the parameters used in the retorting of shale as described above.

When gasifying coal, it is preferred to use sand as the heat-transfer material and to use a reactive fluidization gas containing both oxygen and steam. As in retorting, the oxygen content of the fluidization gas is preferably controlled to provide the heat necessary for the endothermic reaction of coal with steam. Much higher temperatures are required for the gasification of coal than are required for the retorting of shale. Preferably the exothermic combustion reaction raises the temperature of the gases and heat-transfer material to an elevated temperature in the range 1200–3000° F. and more preferably 1800–2500° F. Preferably 5 to 60 weight percent and more preferably 20 to 50 weight percent of the coal is initially entrained upwardly through the gasification zone, the remainder of the coal being fluidized and initially flowing downwardly. A portion of the upflowing entrained solids will only be partially gasified. After removal from the gasification vessel, this portion can be separated from the gaseous product, reintroduced into the bottom of the vessel and combusted, just as with the small-size retorted shale. The initially fluidized coal flows downwardly and reacts with steam, forming a second portion of partially gasified solids. This second portion is then reacted with the oxygen in the fluidization gas in a lower portion of the gasification zone, providing the necessary heat for the endothermic reaction of coal with the steam. As the fluidized portion of the partially gasified coal moves downwardly in the vessel, it will eventually react with steam and oxygen sufficiently so that all that remains is ash, which will generally all be entrained upwardly by the fluidization gas and carried out of the vessel with the product gas. Thus, in contrast to the processing of shale, only the solid heat-transfer material will be removed from the bottom of the vessel when processing coal. The product combustible gas will comprise $H_2$, CO, $CO_2$ and light hydrocarbons such as methane, ethane and propane.

The inlet and outlet means for introducing and removing solids and gases from the retorting or gasification vessel are well known in the fluidization, gasification and retorting art. For example, screw-type feeders can be used for feeding the hydrocarbon-containing and heat-transfer solids into the vessel and a lift gas can be used for conveying the heat-transfer material from the bottom of the vessel to the top.

What is claimed is:

1. A continuous process for gasifying hydrocarbon-containing solids in a vertically elongated gasification zone, said gasification zone including means for substantially impeding vertical back mixing of vertically moving solids substantially throughout said gasification zone, which comprises:

(a) introducing particulate solid heat-transfer material at an elevated temperature into an upper portion of said gasification zone;

(b) maintaining an upward flow of a steam-containing fluidization gas through said gasification zone at a rate sufficient to maintain said heat-transfer material in a fluidized state;

(c) introducing into an intermediate level of said gasification zone a first portion of hydrocarbon-containing solids which is entrained by said fluidization gas and flows upwardly in plug flow through said gasification zone and reacts with said fluidization gas forming a first portion of partially gasified solids and a first portion of combustible gas;

(d) introducing into an intermediate level of said gasification zone a second portion of hydrocarbon-containing solids which is fluidized by said fluidization gas and which reacts with said fluidization gas forming a second portion of partially gasified solids and a second portion of combustible gas;

(e) reacting said second portion of said partially gasified solids in a lower level of said gasification zone with an oxygen-containing gas thereby forming combusted solids and a noncombustion-supporting fluidization gas, whereby said heat-transfer material is heated to an elevated temperature;

(f) maintaining a substantially net downward plug flow of said heat-transfer material and said second portion of said hydrocarbon-containing solids through said gasification zone by withdrawing from a bottom portion of said gasification zone a first effluent stream comprising said heat-transfer material, said effluent stream being withdrawn at an elevated temperature;

(g) withdrawing from an upper portion of said gasification zone a second effluent stream comprising a product combustible gas and said first portion of said partially gasified solids.

2. The process of claim 1 wherein said hydrocarbon-containing solids comprise coal and said heat-transfer material comprises sand.

3. The process of claim 2 comprising the additional step of introducing said first portion of said partially gasified solids into a lower portion of said gasification zone, whereby said first portion of said partially gasified solids is combusted and entrained through said gasification zone by said fluidization gas.

4. The process of claim 1 wherein said first portion of said solids comprises 5 to 60 weight percent of said hydrocarbon-containing solids.

5. The process of claim 1 wherein said first portion of said solids comprises 20 to 50 weight percent of said hydrocarbon-containing solids.

6. A continuous process for gasifying hydrocarbon-containing solids in a vertically elongated vessel substantially filled with a packing material, which comprises:

(a) introducing particulate solid heat-transfer material at an elevated temperature into an upper portion of said vessel;

(b) maintaining an upward flow of a steam-containing fluidization gas through said vessel at a rate sufficient to maintain said heat-transfer material in a fluidized state;

(c) introducing into an intermediate level of said vessel a first portion of hydrocarbon-containing solids which is entrained by said fluidization gas and flows upwardly in plug flow through said vessel and reacts with said fluidization gas forming a first portion of partially gasified solids and a first portion of combustible gas;

(d) introducing into an intermediate level of said vessel a second portion of hydrocarbon-containing solids which is fluidized by said fluidization gas and which reacts with said fluidization gas forming a second portion of partially gasified solids and a second portion of combustible gas;

(e) reacting said second portion of said partially gasified solids in a lower level of said vessel with an oxygen-containing gas thereby forming combusted solids, a noncombustion-supporting fluidization gas, and whereby said heat-transfer material is heated to an elevated temperature;

(f) maintaining a substantially net downward plug flow of said heat-transfer material and said second portion of said hydrocarbon-containing solids through said vessel by withdrawing from a bottom portion of said vessel a first effluent stream comprising said heat-transfer material, said effluent stream being withdrawn at an elevated temperature;

(g) withdrawing from an upper portion of said vessel a second effluent stream comprising a product combustible gas and said first portion of said partially gasified solids.

7. The process of claim 6 wherein said hydrocarbon-containing solids comprise coal and said heat-transfer material comprises sand.

8. The process of claim 7 comprising the additional step of introducing said first portion of said partially gasified solids into a lower portion of said vessel, whereby said first portion of said partially gasified solids is combusted and entrained through said vessel by said fluidization gas.

9. The process of claim 6 wherein said first portion of said solids comprises 20 to 60 weight percent of said hydrocarbon-containing solids.

10. The process of claim 6 wherein said first portion of said solids comprises 20 to 50 weight percent of said hydrocarbon-containing solids.

11. A process for gasifying hydrocarbon-containing solids in a vertically elongated gasification zone, said gasification zone containing means for impeding vertical back mixing of vertically moving solids substantially throughout said gasification zone, which comprises the steps of:

(a) introducing particulate solid heat-transfer material into an upper end of said gasification zone at an elevated temperature and withdrawing heat-transfer material from a lower end of said gasification zone;

(b) passing a fluidization gas stream upwardly through said gasification zone at a rate sufficient to substantially fluidize said heat-transfer material, whereby said heat-transfer material substantially flows downwardly through said gasification zone in plug flow;

(c) introducing said hydrocarbon-containing solids into an intermediate vertical level of said gasification zone, said fluidization gas stream having a superficial velocity such that a first portion of said hydrocarbon-containing solids is entrained in said fluidization gas stream and flows upwardly in plug flow through said gasification zone and a second portion of said hydrocarbon-containing solids is fluidized by said fluidization gas stream and flows downwardly through said gasification zone with said heat-transfer material;

(d) heating said hydrocarbon-containing solids and forming a product gas and partially gasified solids by contacting said hydrocarbon-containing solids with steam in said fluidization gas stream and with said heat-transfer material;

(e) heating said heat transfer material and said fluidization gas stream by combusting downwardly flowing partially gasified solids formed from said second portion of said hydrocarbon-containing solids; and (f) removing said product gas from said upper end of said gasification zone in said fluidization gas stream.

* * * * *